US007427830B2

(12) United States Patent
Taniguchi et al.

(10) Patent No.: US 7,427,830 B2
(45) Date of Patent: Sep. 23, 2008

(54) IMAGE DISPLAY APPARATUS

(75) Inventors: Hirotomo Taniguchi, Kanagawa-ken (JP); Hisanobu Azuma, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 456 days.

(21) Appl. No.: 11/253,581

(22) Filed: Oct. 20, 2005

(65) Prior Publication Data

US 2006/0087219 A1 Apr. 27, 2006

(30) Foreign Application Priority Data

Oct. 26, 2004 (JP) ..... 2004-311033

(51) Int. Cl.
*H01J 29/46* (2006.01)

(52) U.S. Cl. ..... 313/495

(58) Field of Classification Search ..... None
See application file for complete search history.

(56) References Cited

U.S. PATENT DOCUMENTS

| | | | | |
|---|---|---|---|---|
| 5,633,560 | A * | 5/1997 | Huang | 313/495 |
| 5,831,387 | A | 11/1998 | Kaneko et al. | 313/495 |
| 6,076,169 | A | 6/2000 | Lee | 713/320 |
| 6,087,770 | A | 7/2000 | Kaneko et al. | 313/495 |
| 6,137,218 | A | 10/2000 | Kaneko et al. | 313/495 |
| 6,169,356 | B1 | 1/2001 | Ohnishi et al. | 313/495 |
| 6,246,168 | B1 * | 6/2001 | Kishi et al. | 313/495 |
| 6,283,813 | B1 | 9/2001 | Kaneko et al. | 445/24 |
| 6,344,711 | B1 | 2/2002 | Ohnishi et al. | 313/495 |
| 6,384,541 | B1 | 5/2002 | Ohnishi et al. | 315/169.3 |
| 6,703,791 | B2 | 3/2004 | Azuma | 315/169.3 |
| 6,802,752 | B1 | 10/2004 | Ohnishi et al. | 445/6 |
| 6,890,231 | B2 | 5/2005 | Ohnishi et al. | 445/6 |
| 6,908,356 | B2 | 6/2005 | Ohnishi et al. | 445/50 |
| 6,972,203 | B2 | 12/2005 | Azuma | 438/20 |
| 2002/0195924 | A1 * | 12/2002 | Raina | 313/495 |
| 2005/0040752 | A1 * | 2/2005 | Lee et al. | 313/495 |
| 2005/0151703 | A1 | 7/2005 | Ohnishi et al. | 345/55 |
| 2005/0266761 | A1 | 12/2005 | Azuma | 445/5 |
| 2006/0063459 | A1 | 3/2006 | Iba et al. | 445/3 |
| 2006/0087220 | A1 | 4/2006 | Hiroki et al. | 313/495 |
| 2006/0091780 | A1 * | 5/2006 | Minami | 313/495 |
| 2006/0164001 | A1 | 7/2006 | Iba et al. | 313/495 |

FOREIGN PATENT DOCUMENTS

| | | |
|---|---|---|
| JP | 7-235255 | 9/1995 |
| JP | 8-185818 | 7/1996 |
| JP | 9-50757 | 2/1997 |

* cited by examiner

*Primary Examiner*—Ashok Patel
(74) *Attorney, Agent, or Firm*—Fitzpatrick, Cella, Harper & Scinto

(57) ABSTRACT

In an image display apparatus, by providing an insulating member which covers an electroconductive member existing in a region out of an electron beam emitting region, an unnecessary discharge from the electroconductive member is suppressed and a damage due to the discharge is prevented, thereby realizing a long life of the apparatus.

5 Claims, 10 Drawing Sheets

IMAGE DISPLAY APPARATUS

BACKGROUND OF THE INVENTION

1. Field of the Invention

The invention relates to an image display apparatus.

2. Related Background Art

Hitherto, two kinds of sources such as thermionic electron source and cold cathode electron source have been known as electron-emitting devices. As cold cathode electron sources, there are a field emission device (hereinbelow, abbreviated to an "FE type device"), a metal/insulating layer/metal type device (hereinbelow, abbreviated to an "MIM device"), a surface conduction electron-emitting device (hereinbelow, abbreviated to an "SCE device"), and the like.

An image display apparatus in which a number of electron-emitting devices mentioned above are arranged on a substrate and used as an electron source has also been proposed.

Generally, such a kind of image display apparatus has a structure in which a rear plate on which a plurality of electron-emitting devices are arranged in a matrix and a face plate on which phosphor is provided so as to face each of the plurality of electron-emitting devices are arranged so as to face each other. According to such an image display apparatus, by applying a high voltage between the rear plate and the face plate, electrons emitted from the electron-emitting devices collide with phosphor and phosphor emits light. In this instance, by controlling the electron emission from each electron-emitting device, the light emission in each phosphor is controlled, so that an image is displayed.

With respect to a technique regarding the SCE device mentioned above, a part of the prior arts by the same applicant as the present invention will be introduced hereinbelow for reference.

For instance, as examples of the electron source in which the SCE devices are arranged in a matrix and an image display apparatus using such an electron source, Japanese Patent Application Laid-Open No. H08-185818, Japanese Patent Application Laid-Open No. H09-050757, and the like can be mentioned.

FIGS. 9A and 9B show an electron-emitting device (SCE device) used in an image forming apparatus. 91 denotes a substrate. 92 and 93 denote device electrodes having a width W and being spaced form each other by a gap L. 94 denotes an electroconductive film. 95 denotes an electron emitting portion constituted by a fissure formed in the electrodonductive film 94.

According to the conventional image display apparatus using the electron-emitting devices, there is a case where a discharge occurs in the apparatus. When such a discharge occurs, there is a case where The electron-emitting device is damaged. When such a damage occurs in a number of electron-emitting devices, consequently, there is also a fear that a life of the image display apparatus itself is consequently shortened.

SUMMARY OF THE INVENTION

It is an object of the invention to suppress a damage which is caused when a discharge occurs.

BRIEF DESCRIPTION OF THE DRAWINGS

FIGS. 2A and 2B are schematic diagrams showing cross sectional constructions of respective sections in FIG. 1, in which FIG. 2A is a diagram showing a cross sectional construction taken along the solid line 2A-2A in FIG. 1 and FIG. 2B is a diagram showing a cross sectional construction taken along the solid line 2B-2B in FIG. 1, respectively;

FIGS. 3A, 3B, 3C and 3D are schematic diagrams showing an example of a construction of an SCE device sole body according to the embodiment of the invention, in which FIG. 3A is a plan view, FIG. 3B is a side elevational view, FIG. 3C is a schematic diagram showing the state where an electroconductive member constructing the SCE device shown in FIG. 3A is covered with an insulating member, and FIG. 3D is a schematic diagram showing the state where the surface of the insulating member shown in FIG. 3C is further covered with a resistor film;

FIGS. 4A and 4B are diagrams each showing an example of a pattern of an applied voltage in the forming step according to the embodiment of the invention, in which FIG. 4A is a diagram showing the case of applying a pulse voltage of the same peak value and FIG. 4B is a diagram showing a method of applying a pulse voltage while gradually increasing the peak value;

FIGS. 6A and 6B are schematic diagrams showing phosphor films in the image forming apparatus according to the embodiment of the invention, in which FIG. 6A is a diagram showing the phosphor film of black stripes and FIG. 6B is a diagram showing the phosphor film of a black matrix, respectively;

FIGS. 7A, 7B, 7C, 7D and 7E are diagrams showing a forming method of an electron source substrate of the image forming apparatus according to the embodiment of the invention, in which FIG. 7A is an explanatory diagram of step (a), FIG. 7B is an explanatory diagram of step (b), FIG. 7C is an explanatory diagram of step (c), FIG. 7D is an explanatory diagram of step (d), and FIG. 7E is an explanatory diagram of step (e), respectively;

DETAILED DESCRIPTION OF THE PREFERRED EMBODIMENT

An image display apparatus of the invention comprises: a first substrate having a plurality of electron-emitting regions and an electroconductive member on its surface; and a second substrate having anodes which are arranged so as to face the plurality of electron-emitting regions and the electroconductive member and to which electrons emitted from the electron-emitting regions are irradiated, wherein the image display apparatus has an insulating member which covers the electroconductive member excluding the electron-emitting regions.

It is preferable that the insulating member covers at least the whole surface of the electroconductive member arranged in an orthogonal projection region of the anode to the surface of the first substrate.

The electroconductive member can include wirings which connect the plurality of electron-emitting regions and a driving circuit.

The electron-emitting region may be an electroconductive film and a gap formed in a part of the electroconductive film.

The electron-emitting region may be a gap formed in a part of the electroconductive film.

The image display apparatus of the invention can further have a resistor film which covers an exposed surface and the insulating member of the first substrate.

According to the invention, since the progress of the discharge can be suppressed, the damage of the electron-emitting device due to the discharge can be minimized and the life of the image forming apparatus can be extended.

According to the invention, the charging the exposed surface of the substrate where the electron-emitting regions and the electroconductive member are arranged and the charging the insulating member can be suppressed, so that electron-emitting characteristics can be further stabilized and the discharge can be further suppressed.

Subsequently, the best mode to embody the image forming apparatus and its manufacturing method according to the invention will now be described in detail with reference to the drawings.

Figure 1:
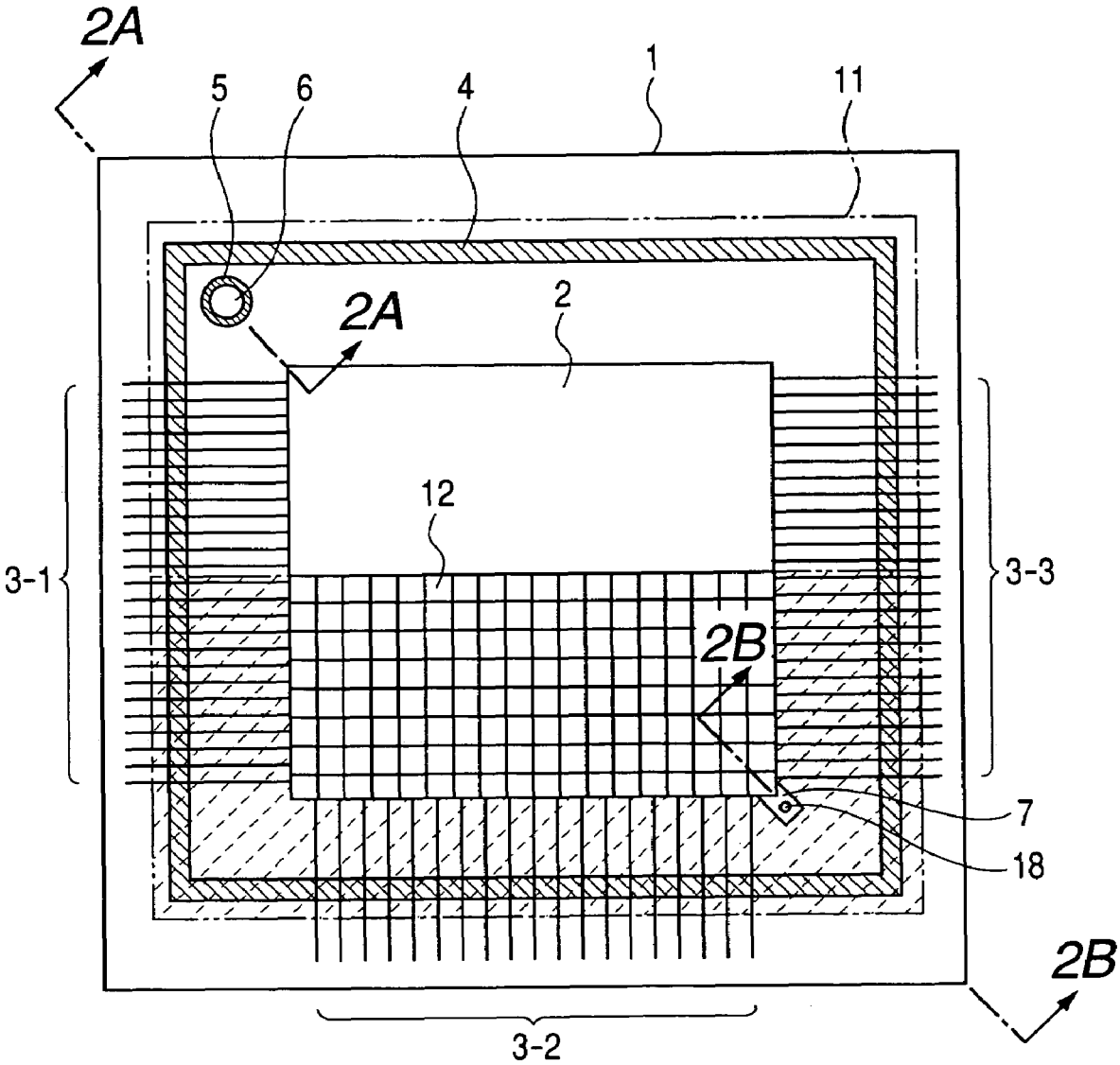
FIG. 1 is a plan view of a display panel schematically showing a construction of an image forming apparatus formed by forming steps based on a manufacturing method of the image forming apparatus according to an embodiment of the invention.

FIG. 1 is a plan view of a display panel schematically showing a construction of an image forming apparatus formed by forming steps based on the manufacturing method of the image forming apparatus according to an embodiment of the invention. This plan view illustrates the construction of the image forming apparatus in the case where it is seen from the position above a face plate and the upper half portion of the face plate is removed for convenience of explanation.

Reference numeral 1 denotes a rear plate (first substrate) also serving as a substrate to form an electron source. A proper one of the following various kinds of materials is used for the rear plate 1 in accordance with conditions: soda lime glass; soda lime glass whose surface is formed with an $SiO_2$ coating film; glass in which a content of Na is small; quartz glass; ceramics; and the like. It is also possible to construct in such a manner that the substrate to form the electron source is formed separately from the rear plate and, after the electron source is formed, both of them are joined.

Reference numeral 11 denotes a face plate (second substrate) also serving as a substrate to form phosphor. A proper one of the following various kinds of materials is used for the face plate 11 in accordance with conditions: that is, soda lime glass; soda lime glass whose surface is formed with an $SiO_2$ coating film; glass in which a content of Na is small; quartz glass; ceramics; and the like.

Reference numeral 2 denotes an electron source in which a plurality of electron-emitting devices such as FE type devices, SCE devices, or the like are arranged and, further, wirings connected to the devices are formed so that the devices can be driven in accordance with a purpose. Reference numerals 3-1, 3-2, and 3-3 denote wirings for driving the electron source. Those wirings are led out of the image forming apparatus and connected to a driving circuit (not shown) of the electron source 2. Reference numeral 4 denotes a supporting frame sandwiched between the rear plate 1 and the face plate 11. The supporting frame 4 is joined to the rear plate 1 by frit glass. The electron source driving wirings 3-1, 3-2, and 3-3 are embedded in the frit glass in the joint portion of the supporting frame 4 and the rear plate 1 and led out to the outside. Insulating layers (not shown) are formed among the electron source driving wirings 3-1, 3-2, and 3-3. In addition to them, a getter (not shown) is arranged in a vacuum vessel together with a supporting member (not shown). There is also a case where a spacer (not shown) for supporting the atmospheric pressure is arranged in accordance with circumstances.

Reference numeral 7 denotes a high-voltage contact portion with a high-voltage introducing terminal 18. An image display region 12 will be described in detail hereinafter.

Figure 2A:
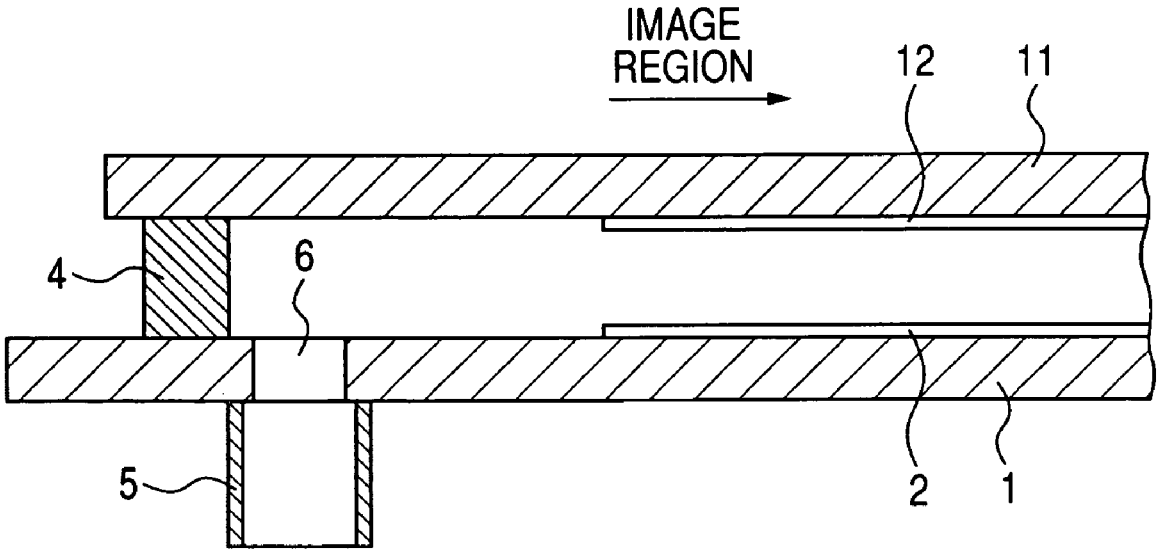

FIG. 2A is a schematic diagram showing a cross sectional construction taken along the solid line 2A-2A in FIG. 1. In the diagram, component elements similar to those in FIG. 1 are designated by the same reference numerals. As shown in the diagram, an exhaust pipe 5 and a vacuum panel are spatially connected through a hole 6 formed in the rear plate 1.

Figure 2B:
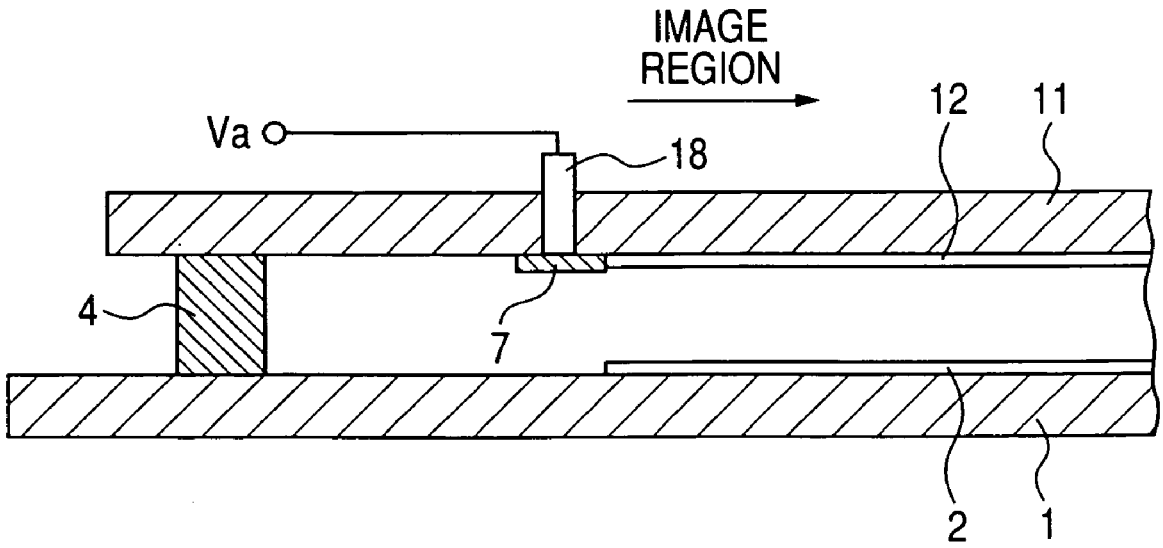

FIG. 2B is a schematic diagram showing a cross sectional construction taken along the solid line 2B-2B in FIG. 1. In the diagram, component elements similar to those in FIG. 1 are designated by the same reference numerals. In the diagram, the high-voltage introducing terminal 18 is connected to the high-voltage contact portion 7 of the image display region 12. Reference numeral 18 denotes the high-voltage introducing terminal for supplying a high voltage (anode voltage Va) to the image display region 12. The high-voltage introducing terminal 18 is a rod made of metal such as Ag, Cu, or the like. In FIGS. 2A and 2B, it is also possible to use such a construction that the high-voltage wirings are led out to the rear plate 1 side.

A kind of electron-emitting devices constructing the electron source region 2 used in the embodiment is not particularly limited but an arbitrary kind of electron-emitting devices can be used so long as their electron-emitting characteristics or a nature such as a size of device or the like is suitable for the target image forming apparatus. Thermionic electron-emitting devices, cold cathode devices such as FE type devices, semiconductor electron-emitting devices, MIM devices, SCE devices, etc., or the like can be used. In the invention, the electron-emitting region is substantially the region where electrons are emitted. In the thermionic electron-emitting device, for example, a filament portion corresponds to the electron-emitting region. In the semiconductor electron-emitting region, for example, a pn junction or a shot-key electrode corresponds to the electron-emitting region. In the MIM device, for example, an upper electrode surface corresponds to the electron-emitting region. In the SCE device, for example, an electroconductive film including a gap or the gap portion or the like corresponds to the electron-emitting region.

The SCE devices shown in the embodiment, which will be explained hereinafter, are preferably used for the embodiment. The SCE devices are the devices similar to those disclosed in Japanese Patent Application Laid-Open No. H07-235255 filed by the same applicant as the present invention mentioned above and will be briefly explained hereinbelow.

Figure 3A:
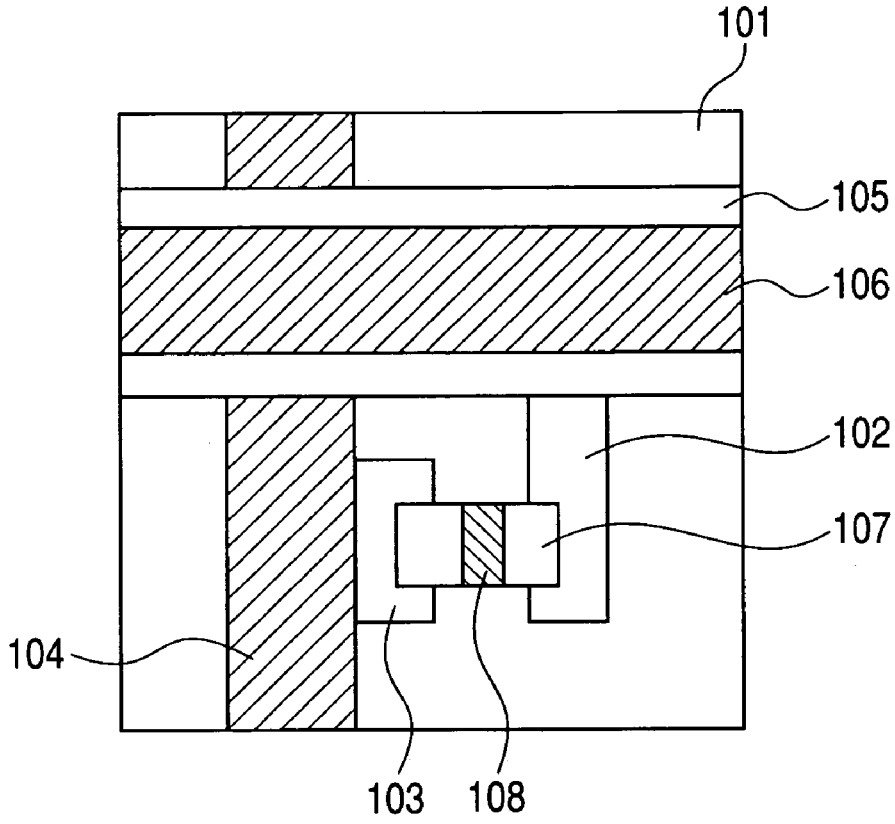
Figure 3B:
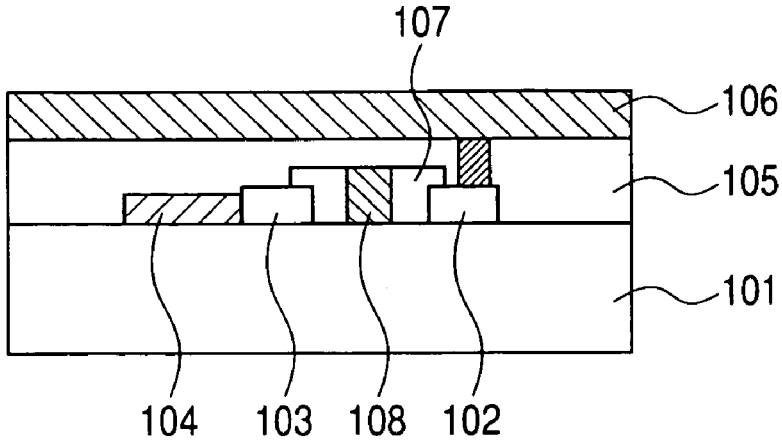

FIGS. 3A to 3D are schematic diagrams showing an example of a construction of the SCE device sole body according to the embodiment. FIG. 3A is a plan view. FIG. 3B is a side elevational view. In FIGS. 3A to 3D, reference numeral 101 denotes a substrate to form the electron-emitting device; 102 and 103 a pair of device electrodes; and 107 an electroconductive film connected to the pair of device electrodes 102 and 103. An electron-emitting region 108 is formed in a part of the electroconductive film 107. The electron-emitting region 108 is a high-resistance portion which is formed when a part of the electroconductive film 107 is broken, deformed, or altered by a forming process, which will be explained hereinafter. A gap is formed in a part of the electroconductive film 107 and electrons are emitted from a portion near the gap. Reference numerals 104 and 106 denote wirings for connecting the driving circuit and the electron-emitting devices. Reference numeral 105 denotes an insulating layer for insulating the wirings 104 and 106.

Figure 3C:
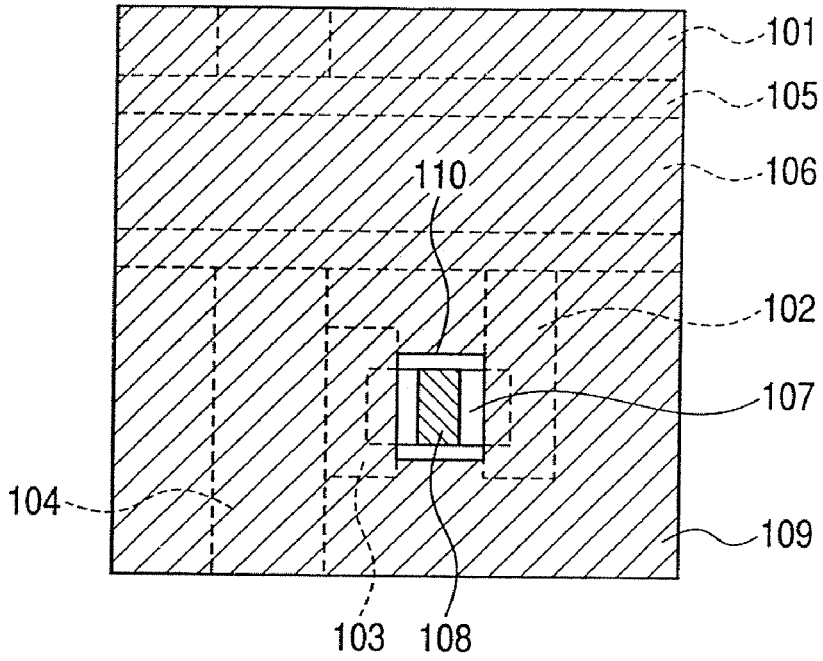

The electroconductive members shown in FIGS. 3A and 3B are covered with the insulating layer (insulating member) in order to suppress a creeping discharge as mentioned above. FIG. 3C is a schematic diagram showing an example in which the electroconductive members according to the embodiment are covered with an insulating layer 109. An opening portion 110 is formed near the electron-emitting region of one SCE device among the electroconductive members arranged on the substrate 101, that is, on the electroconductive members arranged in a first region including the electron-emitting region 108, the electroconductive film 107 around it, and a part of the pair of device electrodes 102 and 103. Among the electroconductive members arranged on the substrate 101, the electroconductive members arranged on a second region including the electroconductive film 107, the pair of device electrodes 102 and 103, and the wirings 104 and 106 which are located at positions out of the region (first region) near the electron-emitting region of the SCE device, that is, out of the first region are covered with the insulating layer 109. The opening portion 110 corresponds to an exposed portion of the electroconductive members which are not covered with the insulating layer 109. If the electron-emitting region is covered with the insulating layer 109, the electron emission from the SCE device is obstructed. Therefore, it is preferable to cover all of the electroconductive members in the region (second region) other than the positions near the electron-emitting region. Although the opening portion 110 is formed in a rectangular shape in the example shown in FIG. 3C, the shape of the opening portion 110 is not limited to such an example but may be another shape such as a circular shape or the like.

Figure 4A:
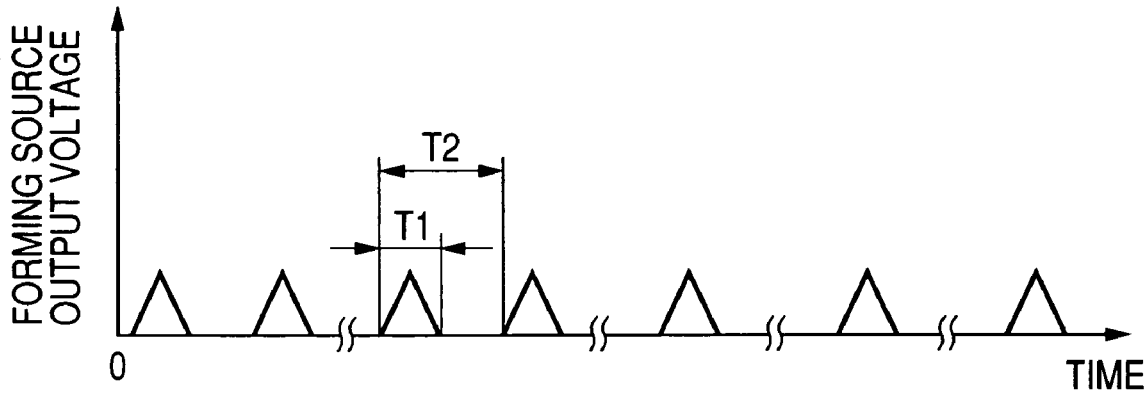
Figure 4B:
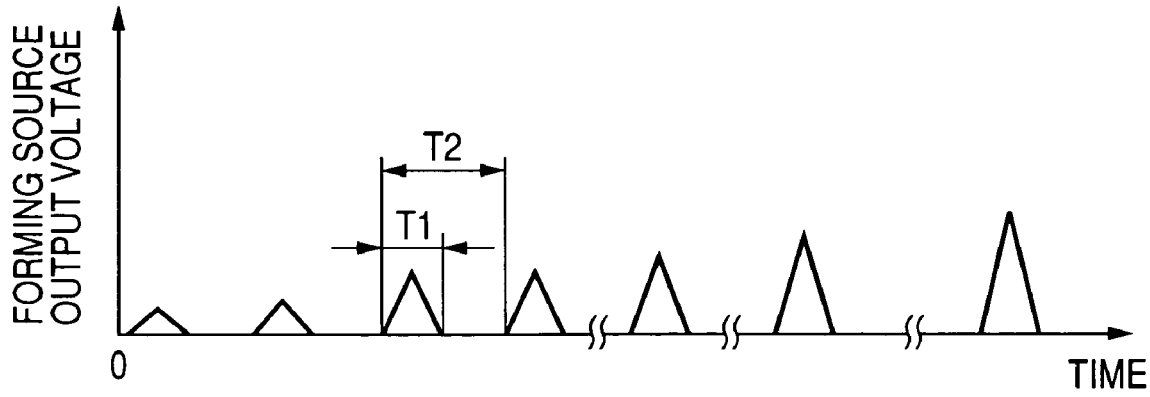

The foregoing forming steps are executed by applying a voltage across the device electrodes 102 and 103. A pulse voltage is preferable as a voltage to be applied. Either a method whereby the pulse voltage of the same peak value is applied as shown in FIG. 4A or a method whereby the pulse voltage is applied while gradually increasing the peak value as shown in FIG. 4B can be used. FIGS. 4A and 4B are diagrams each showing an example of a pattern of the applied voltage in the forming step according to the embodiment. T1 denotes a pulse width and T2 indicates a pulse period, respectively. In the diagrams, an axis of ordinate indicates a voltage value and an axis of abscissa denotes a time. A pulse waveform is not limited to a triangular wave shown in FIGS. 4A and 4B but another shape such as a square wave or the like can be also used.

After the electron-emitting region is formed by the forming process, a process called an "activating step" is executed. According to this process, by repetitively applying the pulse voltage to the device in the atmosphere where an organic substance exists, a substance containing carbon or a carbon compound as a main component is deposited on the electron-emitting region and/or its periphery. By this process, both of a current flowing across the device electrodes (device current If) and a current accompanied by the electron emission (emission current Ie) can be increased.

It is preferable that the electron-emitting device obtained through the forming step and the activating step as mentioned above is subsequently subjected to a stabilizing step. The stabilizing step is a step of evacuating the organic substance existing in the vacuum vessel, particularly, near the electron-emitting region. As a vacuum evacuating apparatus for evacuating the vacuum vessel, it is preferable to use an apparatus using no oil so that the oil which is generated from the apparatus does not exert an influence on characteristics of the device. Specifically speaking, a vacuum evacuating apparatus constructed by a sorption pump and an ion pump or the like can be mentioned.

It is desirable that a partial pressure of the organic substance existing in the vacuum vessel is set to be equal to or less than $1.3\times10^{-6}$ [Pa] as a partial pressure at which the carbon or carbon compound is not newly deposited, particularly, more preferably, $1.3\times10^{-8}$ [Pa] or less. Further, when the inside of the vacuum vessel is evacuated, it is preferable to heat the whole vacuum vessel so that molecules of the organic substance adsorbed to the inner wall of the vacuum vessel or to the electron-emitting devices can be easily evacuated. At this time, as heating conditions, it is desirable to set a temperature to 80 to 250 [° C.], preferably, 150 [° C.] or higher and the process is executed for a time as long as possible. However, the heating conditions are not limited to them but can be properly selected in accordance with various conditions such as size and shape of the vacuum vessel, a structure of the electron-emitting devices, and the like. It is necessary to set a pressure in the vacuum vessel to be as low as possible. Preferably, it is set to $1\times10^{-5}$ [Pa] or less, particularly, more preferably, $1.3\times10^{-6}$ [Pa] or less.

As an atmosphere upon driving after completion of the stabilizing step, it is desirable to maintain the atmosphere at the end of the stabilizing step. However, it is not limited to such an atmosphere. Even if a vacuum degree itself slightly decreases, the sufficiently stable characteristics can be maintained so long as the organic substance has sufficiently been removed. By using such a vacuum atmosphere, the new deposition of carbon or carbon compound can be suppressed and $H_2O$, $O_2$, and the like adsorbed to the vacuum vessel, substrate, and the like can be also removed. Consequently, the device current If and the emission current Ie are stabilized.

Figure 5:
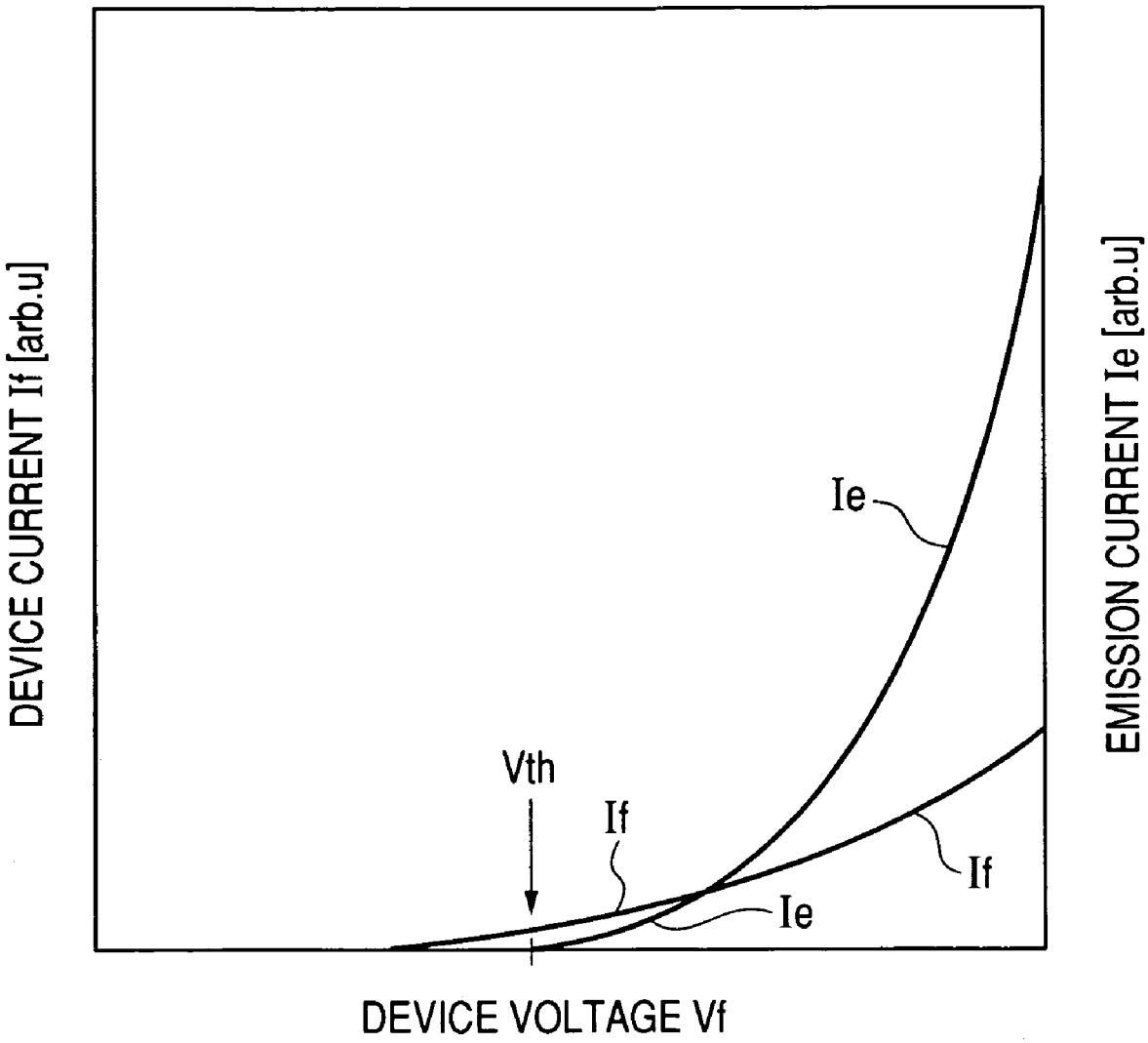
FIG. 5 is a diagram showing relations of the SCE device among a device current If and an emission current Ie to a device voltage Vf which is applied to the SCE device according to the embodiment of the invention.

Characteristics of the device current If and the emission current Ie of the surface conduction electron-emitting device obtained as mentioned above in relation to a device voltage Vf which is applied to the surface conduction electron-emitting device are schematically shown in FIG. 5. In FIG. 5, since the emission current Ie is remarkably smaller than the device current If, it is shown by an arbitrary unit. In the diagram, an axis of ordinate and an axis of abscissa are shown as a linear scale.

As shown in FIG. 5, according to the present surface conduction electron-emitting device, when the device voltage Vf of a certain voltage (called a "threshold voltage"; Vth in FIG. 5) or more is applied, the emission current Ie suddenly increases. On the other hand, when the device voltage Vf less than the threshold voltage Vth is applied, the emission current Ie is hardly detected. In other words, the present surface conduction electron-emitting device is a non-linear device having the distinct threshold voltage Vth to the emission current Ie. If such a device is used, those surface conduction electron-emitting devices are used, matrix wirings are patterned to the electron-emitting devices which are two-dimensionally arranged, electrons are selectively emitted from desired devices by the simple matrix driving, and the electrons are irradiated to the image forming members, thereby enabling an image to be formed.

Figure 6A:
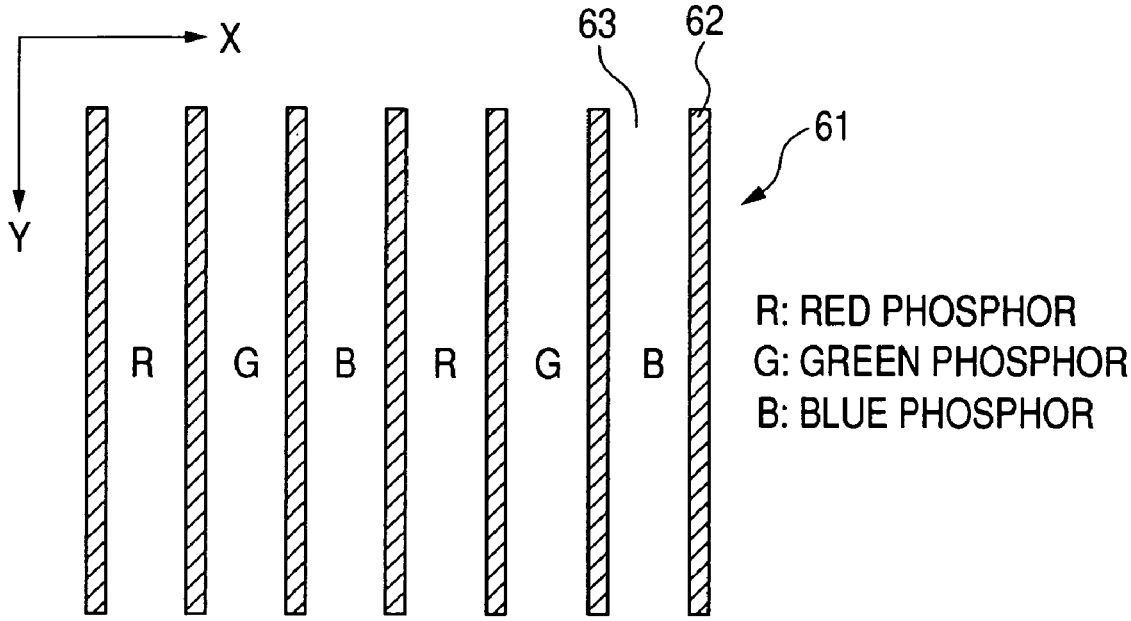
Figure 6B:
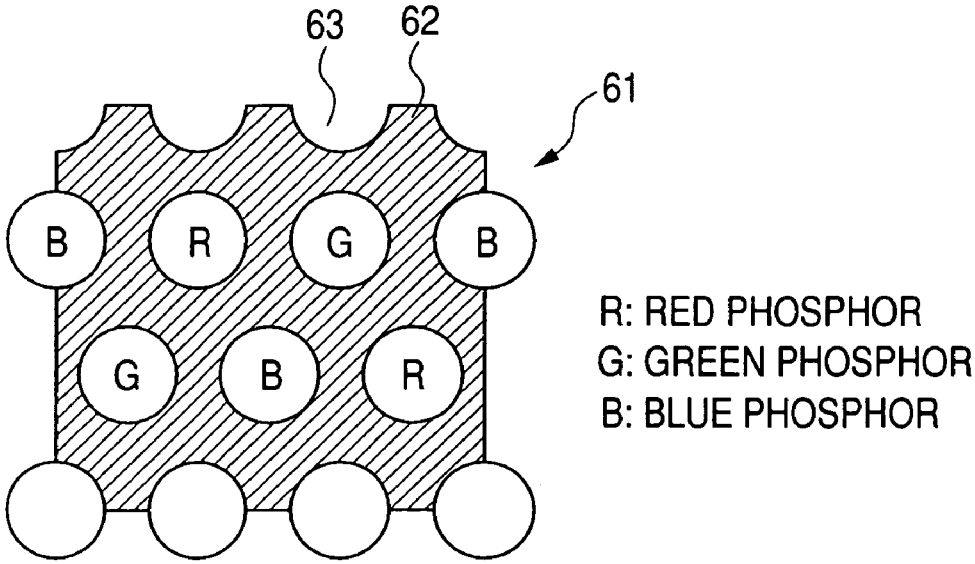

Examples of constructions of phosphor films as image forming members will now be described. FIGS. 6A and 6B are schematic diagrams showing the phosphor films in the image forming apparatus according to the embodiment. FIG. 6A shows the phosphor film of black stripes and FIG. 6B shows the phosphor film of a black matrix, respectively. A phosphor film 61 can be made of only phosphor 63 in the case of a monochromatic display. In the case of the color phosphor film 61, the phosphor film 61 can be made of a black electroconductive material 62 called black stripes (FIG. 6A), black matrix (FIG. 6B), or the like and phosphor 63 of three colors of RGB or the like. An object for providing the black stripes or black matrix is to make color mixture or the like inconspicuous by allowing boundary portions among respective phosphor 63 of three primary colors which are necessary for the color display to be painted in black and to suppress reduction in contrast due to the external light reflection in the phosphor film 61. As a material of the black stripes, besides a material containing graphite as a main component which is ordinarily used, a material having conductivity in which a transmission amount and a reflection amount of light are small can be used.

As a method of coating the face plate in the image forming apparatus with phosphor 63, a precipitating method, a printing method, or the like can be used irrespective of the monochromatic display or the color display. A metal back (not shown) is provided for the inner surface side of the phosphor film 61. An object for providing the metal back is that the light directing toward the inner surface side in the light emitted from phosphor 63 is mirror surface reflected to the face plate side, thereby improving luminance, the metal back is allowed to operate as an electrode for applying an electron beam accelerating voltage, phosphor 63 is protected against a damage due to collision of negative ions generated in an envelope, and the like. The metal back can be formed by a method whereby, after the phosphor film is formed, a smoothing process (generally, called "filming") is executed to the surface on the inner surface side of the phosphor film and, thereafter, Al is deposited by using vacuum evaporation deposition or the like.

A transparent electrode can be also provided for the face plate 11 on the outer surface side of the phosphor film 61 in order to further raise the conductivity of the phosphor film 61. In the case of the color display, since it is necessary to make each color phosphor correspond to each electron-emitting device, it is indispensable to precisely position them.

According to the embodiment having the structure as mentioned above, by covering the electroconductive member with the insulating member, the progress of the discharge is suppressed, the creeping discharge can be prevented, and the damage can be suppressed only in the electron-emitting device in which the discharge has occurred. Therefore, the damage of the electron-emitting device due to the discharge can be minimized, so that the life of the thin flat type electron beam image forming apparatus can be prolonged and its reliability can be improved. The image forming apparatus manufactured as mentioned above is used, scanning signals and image signals are supplied to the electron-emitting devices formed on the matrix wiring coordinates, and the high voltage is applied to the metal back of the image forming member, so that the image display apparatus having such a feature that it is large and thin can be provided.

According to the embodiment, since the image display apparatus is constructed by the SCE device with the electroconductive film in which the electron-emitting region has a gap in a part thereof, the structure is simple, the manufacturing-method is easy, a high electron-emitting efficiency is obtained, and a number of devices can be arranged and formed in a large area.

Figure 3D:
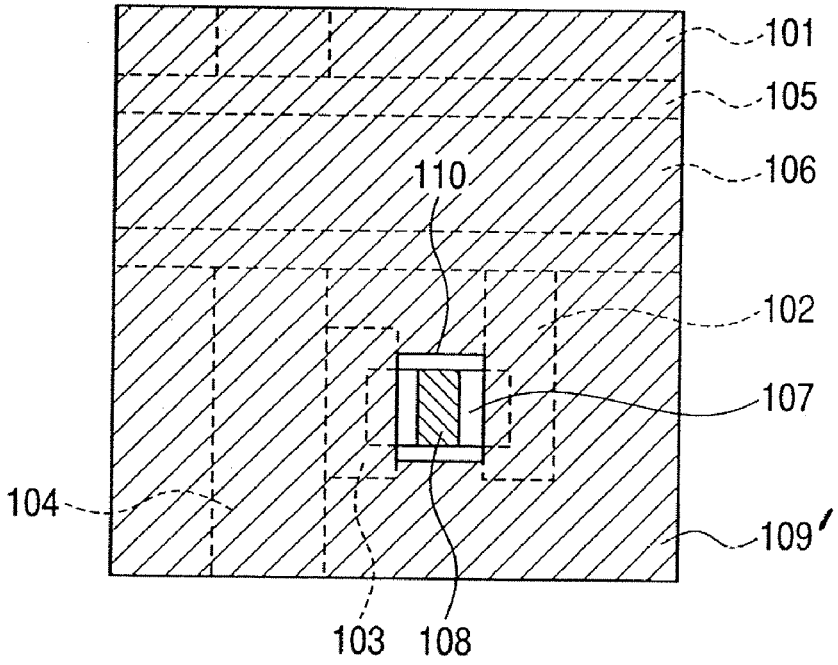

In the embodiment, as shown in FIG. 3D, a resistor film 109', which covers the substrate exposed surface and the insulating layer 109, can be further provided. In this case, the charge of the substrate exposed surface and the insulating layer can be suppressed, so that electron-emitting characteristics can be more stabilized and the discharge can be further suppressed.

EXAMPLES

A manufacturing method of the image forming apparatus according to the embodiment will be further described hereinbelow with reference to the drawings. A plurality of SCE devices are formed on the rear plate also serving as a substrate and wired in a matrix, thereby forming an electron source. The image forming apparatus is formed by using the electron source. FIGS. 7A to 7E are diagrams showing a forming method of the electron source substrate of the image forming apparatus according to the embodiment. Forming steps (a to m) will be described hereinbelow with reference to FIGS. 7A to 7E.

(Step a)

Figure 7A:
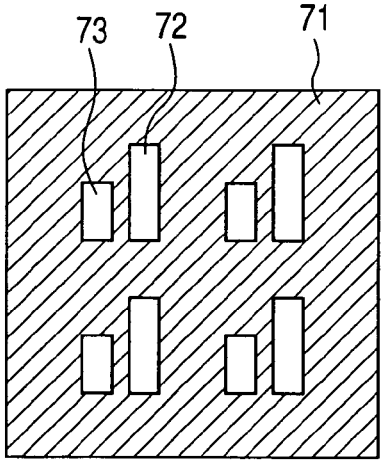

First, as shown in FIG. 7A, an $SiO_2$ layer having a thickness of 0.5 [μm] is formed onto the cleaned surface of soda lime glass by sputtering, thereby obtaining a rear plate 71. Subsequently, a circular through-hole having a diameter of 4 [mm] adapted to introduce a ground connecting terminal is formed by an ultrasonic working machine. Device electrodes 72 and 73 of the SCE device are formed onto the rear plate 71 by using a sputtering film forming method and a photolithography method. As materials of the device electrodes 72 and 73, a Ti layer having a thickness of 5 [nm] and an Ni layer having a thickness of 100 [nm] are laminated. An interval between the devices is set to 2 [μm].

(Step b)

Figure 7B:
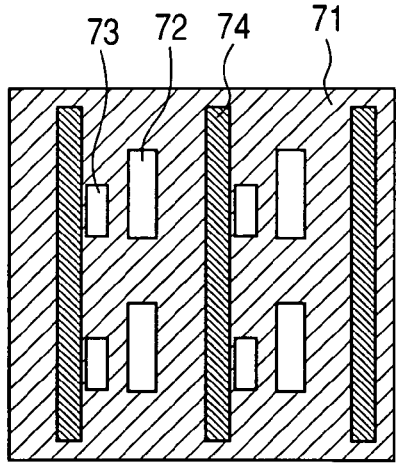

Subsequently, as shown in FIG. 7B, an Ag paste is printed in a predetermined shape and baked, thereby forming Y-directional wirings 74. Each Y-directional wiring 74 is extended to an outside of an electron source forming region and becomes the wiring 3-2 for driving the electron source in FIGS. 2A and 2B. A width of Y-directional wiring 74 is equal to 100 [μm] and its thickness is equal to about 10 [μm].

(Step c)

Figure 7C:
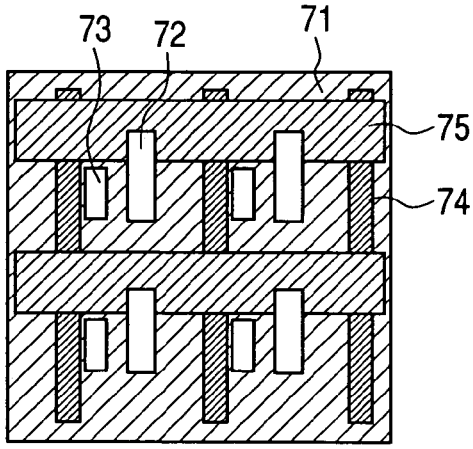

Subsequently, as shown in FIG. 7C, an insulating layer 75 is formed similarly by the printing method by using a paste which contains PbO as a main component and in which a glass binder has been mixed. The insulating layer 75 is formed to insulate the Y-directional wirings 74 from X-directional wirings, which will be explained hereinafter, and is formed so as to have a thickness of about 20 [μm]. A notch is formed in the portion of the device electrode 72, thereby connecting the X-directional wirings with the device electrodes.

(Step d)

Figure 7D:
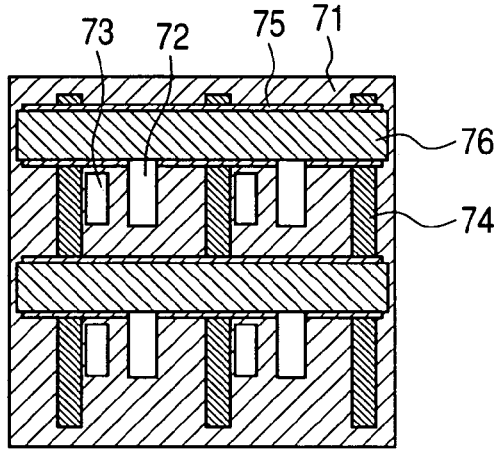

Subsequently, as shown in FIG. 7D, an X-directional wiring 76 is formed on the insulating layer 75. A forming method of the X-directional wiring 76 is similar to that in the case of the Y-directional wirings 74. A width of X-directional wiring 76 is equal to 300 [μm] and its thickness is equal to 10 [μm].

(Step e)

Figure 7E:
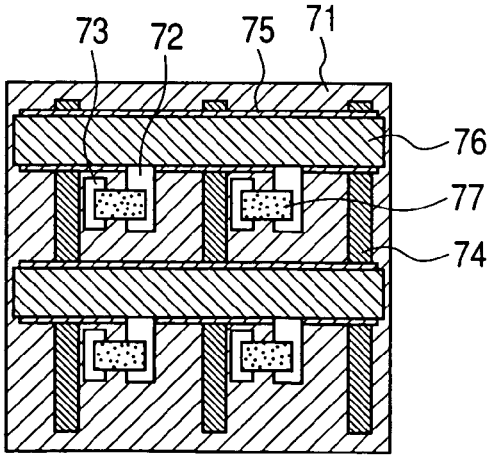

Subsequently, as shown in FIG. 7E, an electroconductive film 77 made of PdO fine particles is formed. As a forming method of the electroconductive film 77, a Cr film is formed by the sputtering method onto the substrate (rear plate) 71 on which the Y-directional wirings 74 and the X-directional wirings 76 have been formed. An opening portion corresponding to a shape of the electroconductive film 77 is formed in the Cr film by the photolithography method. Subsequently, the electroconductive film 77 is coated with a solution of an organic Pd compound (ccp-4230: made by Okuno Pharmaceutical Co., Ltd.) and baked in the atmosphere at 300 [° C.] for 12 minutes, thereby forming a PdO fine particle film. After that, the Cr film is removed by wet etching, thereby forming the electroconductive film 77 of a predetermined shape by lift-off.

(Step f)

Figure 8:
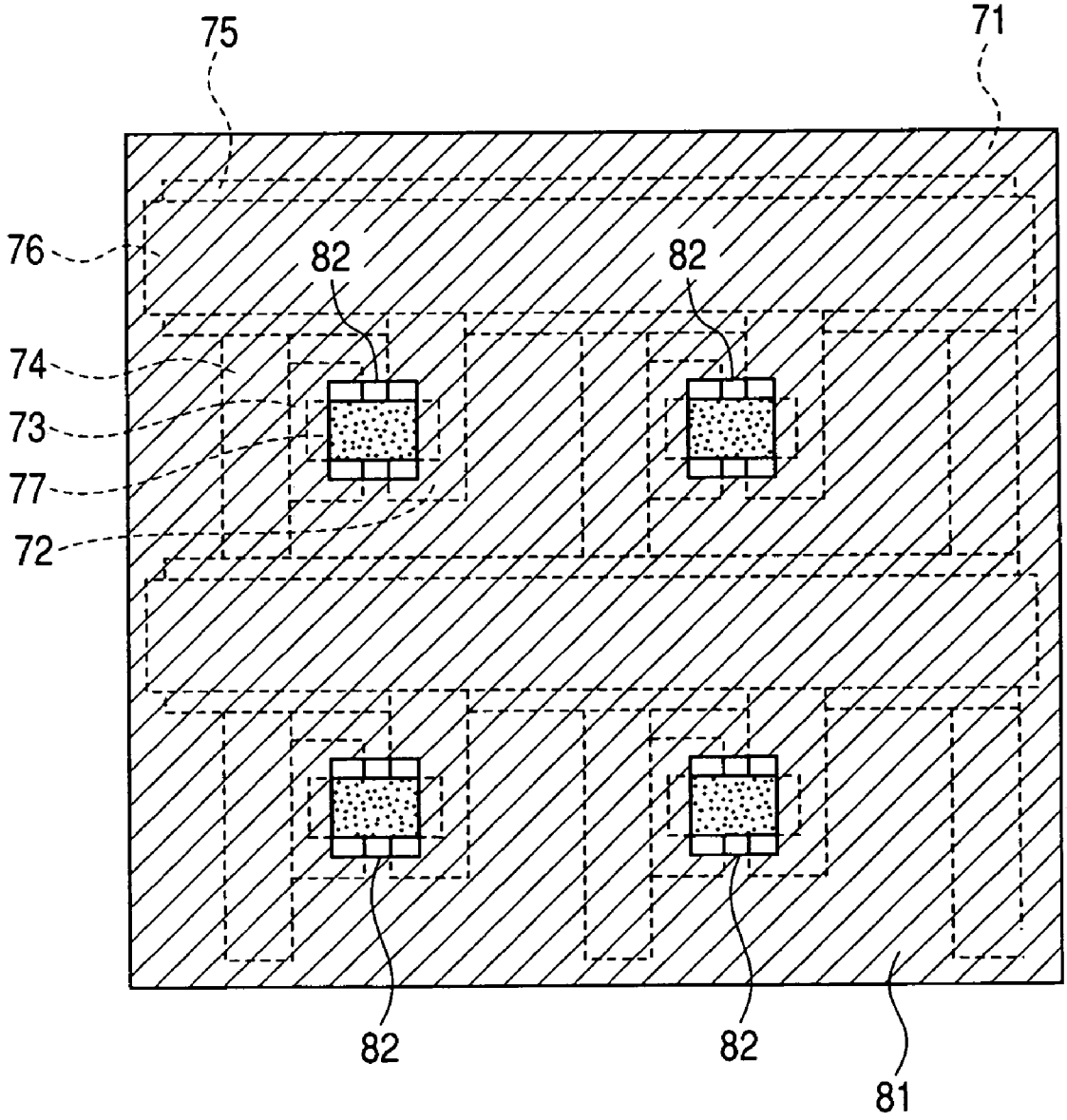
FIG. 8 is a diagram showing the forming method of the electron source substrate of the image forming apparatus according to the embodiment of the invention and is an explanatory diagram of step (f)
Figure 9A:
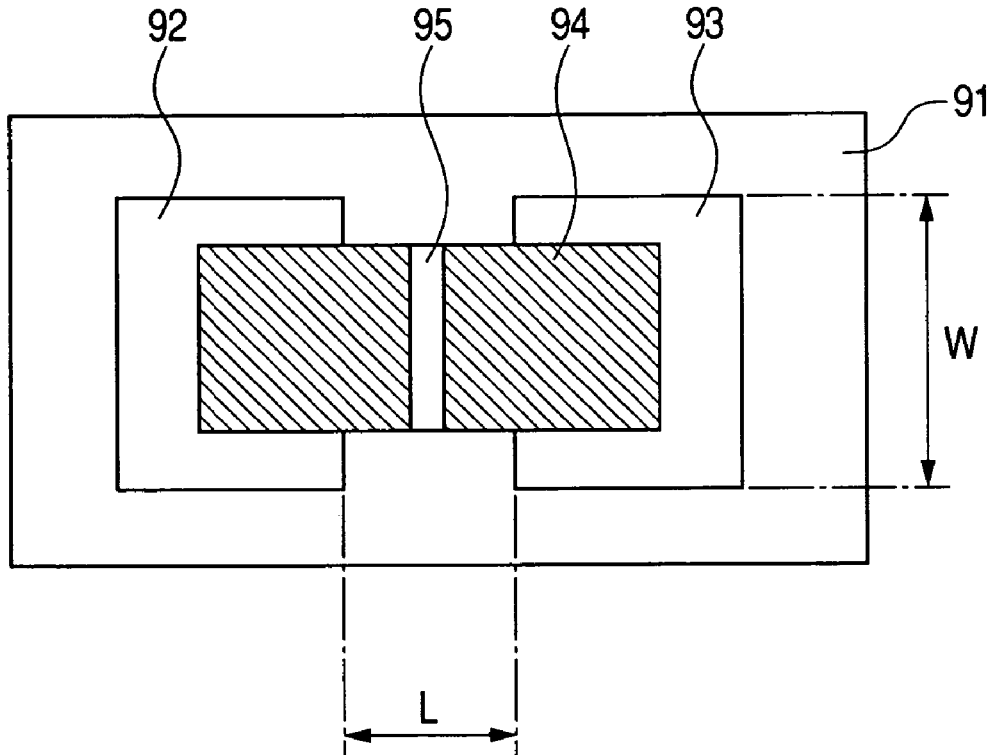
FIGS. 9A and 9B is a plan view of an SCE device according to the prior art.
Figure 9B:
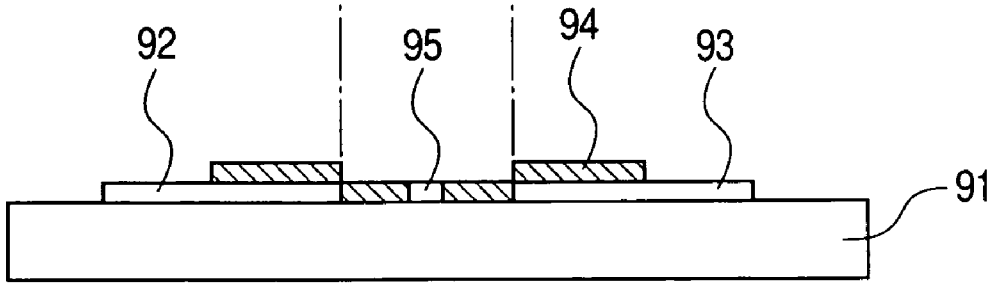

Subsequently, as shown in FIG. 8, an insulating layer (insulating member) 81 is formed by a method similar to that in step c. An opening portion 82 near the electron-emitting device is a region (first region) which is not covered with the insulating layer 81. When the discharge occurs, the opening portion 82 functions so as to suppress the creeping discharge from the discharge-occurring electron-emitting device to the adjacent electron-emitting device.

A setting example of a distance from the center of the electron-emitting device to the edge of the insulating layer (range of the first region) will now be described.

When the discharge occurs, it is necessary to stop the discharge until the scanning voltage is shifted from the discharge-occurring electron-emitting device to the adjacent electron-emitting device, that is, within a 1H time. Since the discharge progresses from the center of the electron-emitting device to the edge of the insulating layer, in order to stop the discharge within the 1H time, it is necessary that a time $\tau$ necessary until the discharge is finished satisfies the following expressions.

$$1H > L/V\text{arc}$$

$$(L/V\text{arc} = \tau)$$

$$L < \alpha(1H * V\text{arc})$$

where,

1H: time during which the scanning voltage is applied

L: distance from the center of the electron-emitting device to the edge of the insulating layer Varc: progressing speed of the discharge arc It is known that Varc is equal to a value within a range from 10 to 100 m/sec from Raymond L., Boxman, Philip J., Martin, and David M., "Handbook of vacuum arc science and technology", Sanders Noyes Publications, 1995, or the like, although it depends on a construction of the members. It has been also confirmed from various experiments that Varc lies within such a range. It is now preferable to set Varc to (Varc=10 m/sec) in consideration of the worst case corresponding to a low speed. "$\alpha$" is a parameter showing a discharge relaxation time which is necessary until the creeping discharge does not occur after the discharge arc reached the insulating layer edge. "$\alpha$" is equal to about 1 to 0.1 and depends on the insulating layer material.

Now, assuming that 1H is equal to 20 μsec, the distance L is obtained as follows by the above relational expressions.

$$L < (1 \text{ to } 0.1) \times (10 \text{ m/sec} \times 20\ \mu\text{sec}) = 200 \text{ to } 20\ \mu\text{m}$$

Therefore, it is necessary that the distance L from the center of the electron-emitting device to the edge of the insulating layer is smaller than a value within a range from 200 to 20 μm. It is set to a value smaller than 200 μm, preferably, smaller than 20 μm.

(Step g)

The surface on the rear plate 1 shown in FIG. 1 is further coated with a charge preventing film paste which contains graphite fine particles as a main component and whose sheet resistance is equal to a value within a range from the ninth power to the twelfth power and it is dried, thereby forming a resistor film. A coating region is only the whole substrate surface or only the inside of the vacuum region.

(Step h)

The supporting frame 4 (FIG. 1) forming a gap between the rear plate 1 and the face plate 11 and the rear plate 1 are connected by using a frit glass. Simultaneously with it, the getter (not shown) is also fixed by using a frit glass.

(Step i)

Subsequently, the face plate 11 (FIG. 1) is formed. As a face plate 11, a soda lime glass provided with an $SiO_2$ layer is used as a substrate in a manner similar to the rear plate 1. Subsequently, an opening portion to connect the exhaust pipe and a port to introduce the high-voltage connecting terminal are formed by ultrasonic working. Then, a high-voltage connecting terminal contact portion and wirings to connect it to the metal back, which will be explained hereinafter, are formed by Au by printing. Further, the black stripes of the phosphor film and, subsequently, stripe-shaped phosphor are formed. The filming process is executed. After that, an Al film having a thickness of about 2000 [X] is deposited onto the phosphor film by the vacuum evaporation depositing method, thereby forming the metal back. The organic substance as a filming material is burnt down by baking.

(Step j)

The supporting frame 4 (FIG. 1) joined to the rear plate 1 is joined to the face plate 11 by using the frit glass. Simultaneously with it, the high-voltage introducing terminal and the exhaust pipe are also joined. The high-voltage introducing terminal is a rod made of Ag. Each electron-emitting device of the electron source and the phosphor film of the face plate 11 are carefully positioned so that their positions accurately correspond to each other. In this instance, an interval between the rear plate 1 and the face plate 11 is set to about 2 [mm].

(Step k)

The image forming apparatus is connected to a vacuum evacuating apparatus through the exhaust pipe (not shown) and the inside of the vessel is evacuated. When a pressure in the vessel reaches $10^{-4}$ [Pa] or less, the forming process is executed. The forming step is executed by applying a pulse voltage whose peak value gradually increases as shown in the schematic diagram of FIG. 4B to the X-directional wirings every row in the X direction. The pulse period T2 is set to 10 [sec] and the pulse width T1 is set to 1 [msec]. Although not shown, a rectangular wave pulse whose peak value is equal to 0.1 [V] is inserted between the forming pulses, a current value is measured, and a resistance value of the electron-emitting device is simultaneously measured. When the resistance value per device exceeds 1 [MΩ], the forming process of this row is finished and the process for the next row is started. By repeating those processes in this manner, the forming processes regarding all rows are completed.

(Step l)

Subsequently, the activating process is executed. Prior to executing this process, the vacuum vessel is evacuated by the ion pump while keeping the image forming apparatus at 20 [° C.] and the pressure is reduced to $10^{-5}$ [Pa] or less. Subsequently, acetone is introduced into the vacuum vessel. An introduction quantity of acetone is adjusted so that the pressure is equal to $1.3 \times 10^{-2}$ [Pa]. Subsequently, the pulse voltage is applied to the X-directional wirings. As a pulse waveform, a rectangular wave pulse whose peak value is equal to 16 [V] is used and a pulse width is set to 100 [μsec]. Such operations that the X-directional wirings to which the pulse is applied at an interval of 125 [μsec] are switched to those of the adjacent row every pulse and the pulse is sequentially applied to each wiring in the row direction are repeated. Thus, the pulse is applied to each row at an interval of 10 [msec]. As a result of the above processes, the deposited film made of carbon as a main component is formed near the electron-emitting region of each electron-emitting device. The device current If and the emission current Ie increase.

(Step m)

Subsequently, the inside of the vacuum vessel is again evacuated as an activating step. The evacuation is continued for ten hours by using the ion pump while keeping the image forming apparatus at 200 [° C.]. This step is provided to remove the organic substance molecules remaining in the vacuum vessel, to prevent the deposited film made of carbon as a main component from being deposited furthermore, and to stabilize the electron-emitting characteristics.

(Step n)

The pulse voltage is applied to the X-directional wirings by a method similar to that used in step l. Further, by applying a voltage of 5 [kV] to the image forming member through the high-voltage introducing terminal mentioned above, the phosphor film emits the light. It is confirmed by the eyes that there are no light-emitting portions or no very dark portions. The supply of the voltages to the X-directional wirings and to the image forming member is stopped and the exhaust pipe is thermally melt-bonded and sealed. Subsequently, the getter process is executed by high-frequency heating, thereby completing the image forming apparatus, As a result of executing various experiments to the image forming apparatus using the electron source substrate formed in the above steps, it has been confirmed that the damage upon discharging was minimized and the continuous damage due to the creeping discharge was suppressed.

This application claims priority from Japanese Patent Application No. 2004-311033 filed Oct. 26, 2004, which is hereby incorporated by reference herein.

What is claimed is:

1. An image display apparatus comprising:

a first substrate having a plurality of electron-emitting regions and an electroconductive member on its surface; and a second substrate having anodes which are arranged so as to face said plurality of electron-emitting regions and said electroconductive member and to which electrons emitted from said electron-emitting regions are irradiated, wherein said image display apparatus has an insulating member which covers said electroconductive member excluding said electron-emitting regions, and wherein said insulating member covers at least the whole surface of said electroconductive member arranged in an orthogonal projection region of at least one of said anodes to the surface of said first substrate.

2. An apparatus according to claim 1, wherein said electroconductive member includes wirings which connect said plurality of electron-emitting regions and a driving circuit.

3. An apparatus according to claim 1, wherein said electron-emitting region is an electroconductive film and a gap formed in a part of said electroconductive film.

4. An apparatus according to claim 3, wherein said electron-emitting region is a gap formed in a part of said electroconductive film.

5. An apparatus according to claim 1, further comprising a resistor film which covers an exposed surface of said first substrate and said insulating member.

* * * * *